US006884208B2

(12) United States Patent
Haws

(10) Patent No.: US 6,884,208 B2
(45) Date of Patent: Apr. 26, 2005

(54) METHOD AND APPARATUS FOR MAKING RECLOSABLE BAGS HAVING SLIDER-ACTUATED STRING ZIPPERS

(75) Inventor: Lewis Albert Haws, Knoxville, TN (US)

(73) Assignee: Illinois Tool Works Inc., Glenview, IL (US)

( * ) Notice: Subject to any disclaimer, the term of this patent is extended or adjusted under 35 U.S.C. 154(b) by 10 days.

(21) Appl. No.: 10/655,991

(22) Filed: Sep. 5, 2003

(65) Prior Publication Data

US 2005/0054504 A1 Mar. 10, 2005

(51) Int. Cl.[7] ..... B31B 1/84

(52) U.S. Cl. ..... 493/213; 493/189; 493/198; 493/200; 493/214; 493/239

(58) Field of Search ..... 493/213, 195, 493/198, 200, 214, 239, 189

(56) References Cited

U.S. PATENT DOCUMENTS 6,212,857 B1 * 4/2001 Van Erden ..... 53/412
6,553,740 B1 * 4/2003 Delisle ..... 53/133.4
6,581,358 B1 * 6/2003 Buchman ..... 53/412
6,662,843 B1 * 12/2003 Johnson ..... 156/519

* cited by examiner

*Primary Examiner*—Eugene Kim
*Assistant Examiner*—Christopher Harmon
(74) *Attorney, Agent, or Firm*—Ostrager Chong Flaherty & Broitman P.C.

(57) ABSTRACT

Methods and apparatus for eliminating unattached remnants or tails of bag making film adjacent a string zipper during manufacture of reclosable bags. Gathered film tails may interfere with slider insertion or slider operation or may cause the film to be pulled off of or peeled away from the string zipper during slider operation. After trimming, the tails of the film are welded to the zipper by conductive heat sealing or equivalent means.

25 Claims, 7 Drawing Sheets

METHOD AND APPARATUS FOR MAKING RECLOSABLE BAGS HAVING SLIDER-ACTUATED STRING ZIPPERS

BACKGROUND OF THE INVENTION

This invention generally relates to methods and apparatus for manufacturing reclosable bags. In particular, the invention relates to methods and apparatus for making reclosable packages having slider-operated string zippers.

Reclosable bags are finding ever-growing acceptance as primary packaging, particularly as packaging for foodstuffs such as cereal, fresh fruit and vegetables, snacks and the like. Such bags provide the consumer with the ability to readily store, in a closed, if not sealed, package any unused portion of the packaged product even after the package is initially opened.

Reclosable bags comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag making film, for example, by conduction heat sealing. These separate closure strips typically have flanges (also called fins) extending therefrom in such a way that the flanges can be joined to bag making film in order to attach the closure strips to the film. Previous slider-operated, separately extruded zippers used flange-type constructions.

An alternative zipper design is the so-called flangeless or string zipper, which has no flange portion above or below the interlockable closure profiles. In the case of a string zipper, the bag making film is joined to the backs of the bases of the closure strips. String zippers can be produced at much greater speeds, allow much greater footage to be wound on a spool, thereby requiring less set-up time, and use less material than flanged zippers, enabling a substantial reduction in the cost of manufacture and processing.

U.S. patent application Ser. No. 10/367,450, entitled "Reclosable Packaging Having Slider-Operated String Zipper", discloses a reclosable bag in which respective marginal portions of the bag film are sealed to the backs of respective flangeless zipper strips and in which the resulting string zipper is actuated by means of a straddling-type slider having a plow that separates the zipper strips during opening.

U.S. patent application Ser. No. 10/436,433, entitled "Method and Apparatus for Inserting Sliders During Automated Manufacture of Reclosable Bags", disclosing a method of manufacturing bags with slider-actuated string zippers. The method involves attaching string zipper at its bases to respective portions of the bag making film using a band or "drag" sealer and then pressing a slider clip across the zippered film. The band sealer welds the zipper to the film by conductive heat sealing in approximately respective central band-shaped zones on the bases of the respective zipper strips. Excess unsealed film on the consumer side of the zipper is then removed or trimmed in a downstream process.

A razor-sharp knife can be used to trim excess film after the string zipper and film have been joined. More specifically, a pair of stationary knives can be placed on opposing sides of the zippered film to slit the excess unsealed film on both sides concurrently as the web of film is advanced on the machine. The portion of the excess unsealed film severed from the zipper-film assembly is taken away. In theory, each knife could be placed so that the knife tip is as close to the zipper as one-half of the width of the knife blade. However, the zipper wanders during the manufacturing process so that the distance between the moving zipper and the tips of the stationary knifes is subject to variation during the manufacturing process. As the zipper wanders, a knife placed too close or pressed against the zipper could cut the zipper if the zipper tended to wander towards the knife, thereby causing sufficient pressure to cut the zipper. Thus, the tip of each knife can be set as close as one-half of the width of the knife tip away, but in practice, zipper wander will result in a knife position further away from the zipper than one-half width of the knife blade to provide a tolerance for zipper wandering.

After trimming, the resulting zipper-film assembly has respective "tails" or remnants of excess unsealed film on the consumer side of the zipper-film band-shaped zones of joinder. Even if the excess film could be cut closer to the zipper-film seal, instead of one-half of the knife blade width away, invariably some tail will remain. In some cases, these tails may extend beyond the tops of the zipper strips. If these tails are not removed, several problems can result. As the slider clips are pressed onto the zipper film, the unattached tail ends tend to gather or bunch up when the slider clip drags across the film. The gathered film can interfere with fully seating the slider clip around the zippered film. Also, the film can be pulled or peeled away from the zipper. During usage of the completed package, gathered film along the lip of the bag mouth may interfere with the function of the seated slider, which is to open and close the zipper during slider travel.

There is a need for a method and an apparatus for making slider-actuated string zipper bags having improved functionality and manufacturability.

BRIEF DESCRIPTION OF THE INVENTION

The present invention is directed to methods and apparatus for low-cost manufacture of slider-actuated string zipper bags having improved functionality and manufacturability. In particular, the invention provides means for eliminating unattached remnants or tails of bag making film adjacent the string zipper. Gathered film tails may interfere with slider insertion or slider operation or may cause the film to be pulled off of or peeled away from the string zipper during slider operation. After trimming, the tails of the film are welded to the zipper by conductive heat sealing or equivalent means.

One aspect of the invention is a method of manufacture comprising the following steps: (a) joining a first portion of a length of film material to a back of a length of a first flangeless zipper strip having a first closure profile on its front; (b) joining a second portion of the length of film material to a back of a length of a second flangeless zipper strip having a second closure profile on its front, the first and second closure profiles of the respective lengths of the first and second zipper strips being interlockable to form a length of string zipper assembly; (c) after steps (a) and (b), removing an unattached marginal portion of the length of film material that extends beyond the joined first portion of the length of film material, leaving a first tail portion of the length of film material unattached to the first flangeless zipper strip; and (d) after step (c), joining the first tail portion of the length of film material to the first flangeless zipper strip. Optionally, steps analogous to steps (c) and (d) can be performed on the unattached marginal portion of film material that extends beyond the joined second portion of the film material.

Another aspect of the invention is a machine comprising: first joining means for joining a first portion of a length of film material to a back of a length of a first flangeless zipper strip; second joining means for joining a second portion of the length of film material to a back of a length of a second flangeless zipper strip; first trimming means for removing a first unattached marginal portion of the length of film material that extends beyond the joined first portion of the length of film material, leaving a first tail portion of the length of film material unattached to the first flangeless zipper strip; and third joining means for joining the first tail portion of the length of film material to the first flangeless zipper strip, wherein the first trimming means is disposed between the first and third joining means. Similar means can be provided for removing a second unattached marginal portion of film material that extends beyond the joined second portion of the film material and then joining the corresponding tail portion to the second flangeless zipper strip.

A further aspect of the invention is a method of manufacture comprising the following steps: (a) interlocking a first closure profile of a first flangeless zipper strip with a second closure profile of a second flangeless zipper strip; (b) joining a first band-shaped portion of an elongated film structure to a back of the first flangeless zipper strip; (c) joining a second band-shaped portion of the elongated film structure to a back of the second flangeless zipper strip; (d) removing a first unattached marginal portion of the elongated film structure that extends beyond the joined first band-shaped portion of the elongated film structure, leaving a first tail portion of the elongated film structure unattached to the first flangeless zipper strip; (e) joining the first tail portion of the elongated film structure to the first flangeless zipper strip; and (f) inserting a slider on the interlocked first and second zipper strips some time after completion of steps (a) through (e). Optionally, steps analogous to steps (d) and (e) can be performed on the unattached marginal portion of the elongated film structure that extends beyond the joined second band-shaped portion of the elongated film structure.

Yet another aspect of the invention is an automated production line comprising the following components: a zipper sealer for sealing a band-shaped portion of a section of a web of packaging film to the back of a section of a flangeless zipper strip; a knife arranged for trimming off an unsealed marginal portion of the section of the web downstream of the zipper sealer; and a lip sealer arranged for sealing, to the zipper strip, any unsealed tail portion that remains after the unsealed marginal portion has been trimmed.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
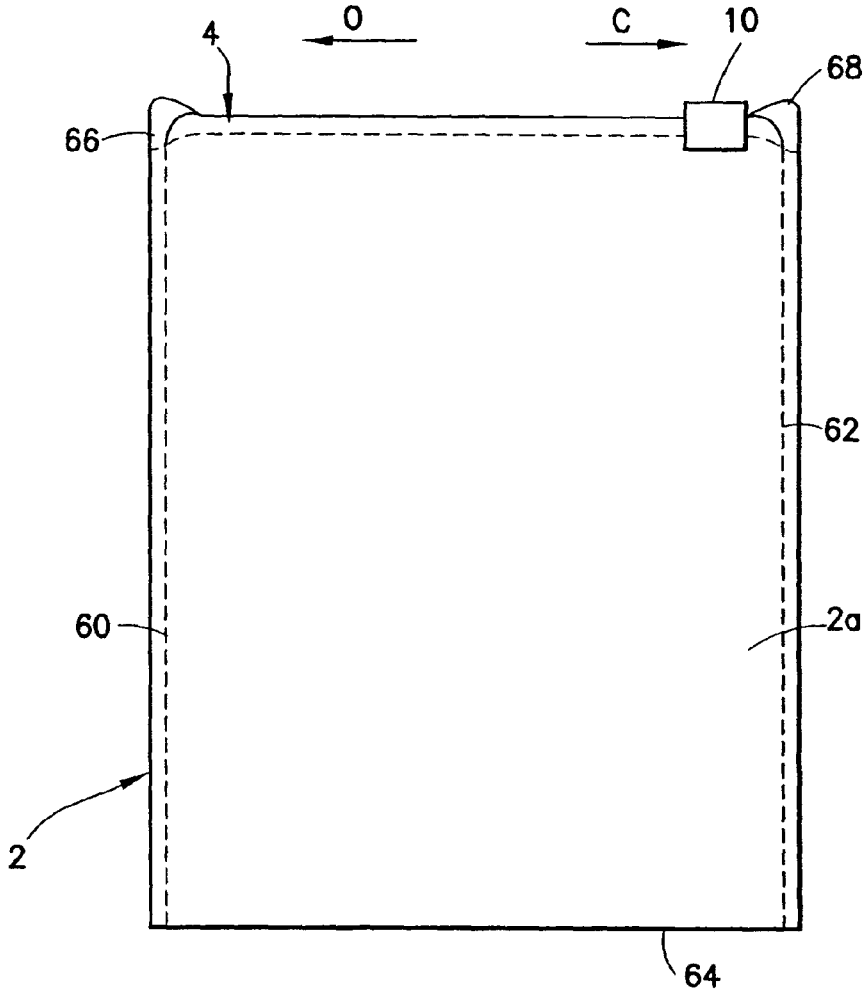
FIG. 1 is a drawing showing a reclosable package having a slider-operated string zipper with slider end stops.

A reclosable package or bag comprising a receptacle 2 and a flexible plastic string zipper 4, operated by manipulation of a slider 10, is shown in FIG. 1. The bottom of the string zipper is represented as a dashed line to reflect the fact that the top margin of the front wall of the receptacle is sealed to the outer surface or back of one zipper strip. If the wall were made of transparent material, then the bottom of the zipper would be visible in the view of FIG. 1 and could be represented as a solid line.

The present invention is directed to methods and apparatus for making reclosable bags of the type shown in FIG. 1 as well as string zipper/slider reclosable bags having structures different than that shown in FIG. 1. For example, many other types of slider end stops could be used.

Referring to FIG. 1, the receptacle 2 may be made from any suitable film material, including thermoplastic film materials such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. Although not intended in a limitative sense, it is noted that the thickness of the film is preferably 2 mils or less.

The receptacle 2 comprises opposing walls (only the front wall 2*a* is visible in FIG. 1) that may be secured together at opposite side edges of the bag by seams 60 and 62 (indicated by dashed lines). The opposing bottoms of the walls may be joined, for example, by means of a heat seal made in conventional fashion, e.g., by application of heat and pressure. Typically, however, the bottom of the package is formed by a fold 64 in the original packaging film, as depicted in FIG. 1.

Figure 2:
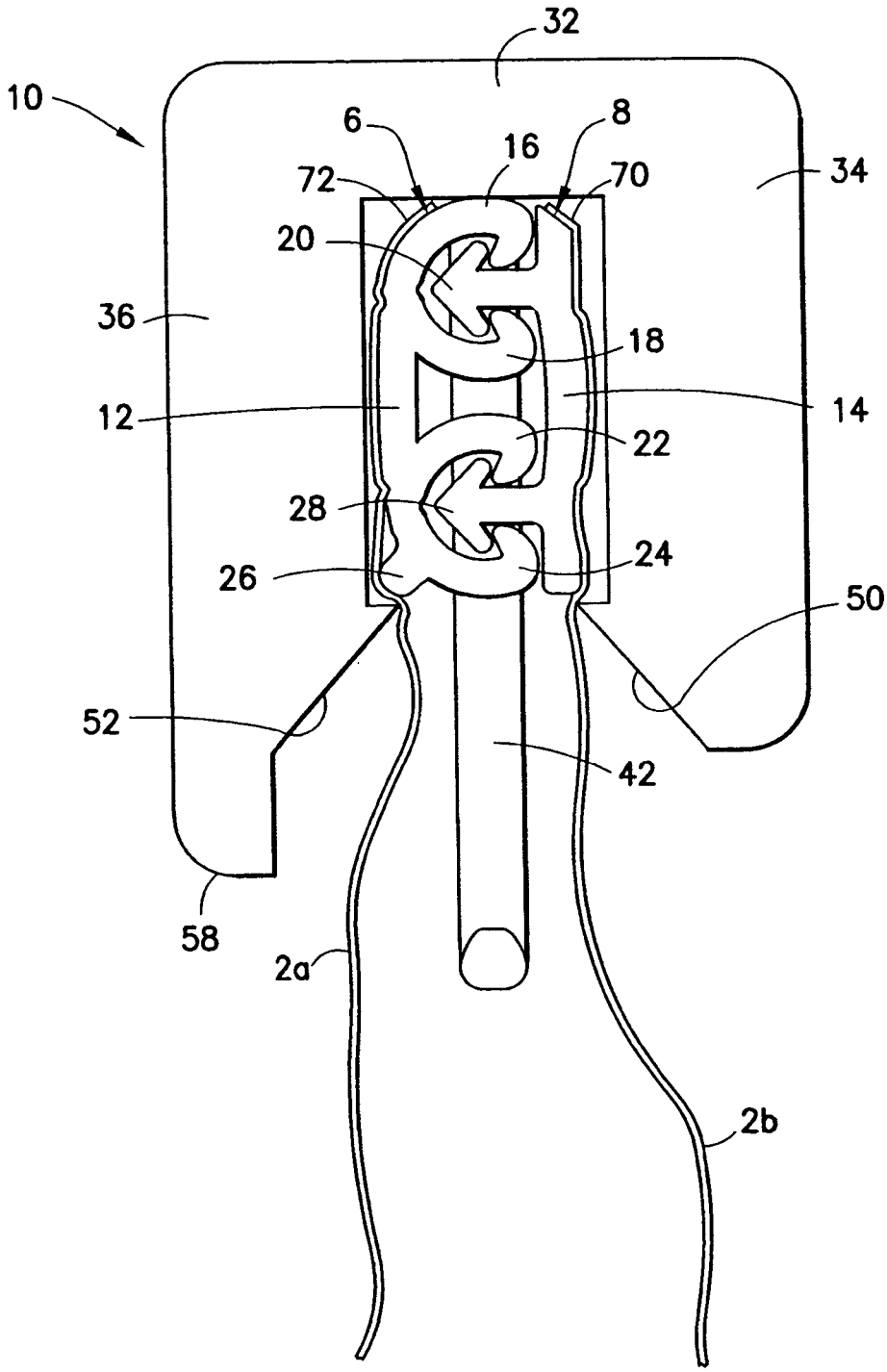
FIG. 2 is a drawing showing a fragmentary sectional view of a slider-string zipper assembly incorporated in the bag depicted in FIG. 1. The zipper and bag film are shown sectioned in a plane in front of the closing end of the slider.

At its top end, the receptacle 2 has an openable mouth, on the inside of which is an extruded plastic string zipper 4. The string zipper 4 comprises a pair of interlockable zipper parts or closure strips 6 and 8 (best seen in FIG. 2). Although FIG. 2 shows a rib and groove arrangement, the profiles of the zipper halves may take any form. For example, the string zipper may comprise interlocking rib and groove elements (as shown in FIG. 2) or alternating hook-shaped closure elements. The preferred zipper material is polyethylene or polypropylene. The top margins of the front and rear walls 2*a* and 2*b* (see FIG. 2) are respectively sealed to the backs of the zipper strips 6 and 8, e.g., by a conventional conduction heat sealing technique. In particular, the top edges 70, 72 of the front and rear walls 2*a*, 2*b* (i.e., which edges constitute the "lip" of the mouth of the receptacle) are respectively sealed to the top portions of the zipper strips 6 and 8. The method and apparatus for accomplishing lip sealing will be described in detail later.

The string zipper is operated by sliding the slider 10 along the zipper parts. As the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The bag shown in FIG. 1 further comprises end stops 66 and 68 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. In accordance with one embodiment of the invention, the end stops comprise stomped areas on the zipper parts themselves. The stomped end stops comprise sections of the zipper parts that have been fused together and flattened at the ends of the zipper. During deformation, thermoplastic zipper material flows upward such that the end stops are raised in height above the peak of the undeformed zipper on which the slider rides. Such stomping can be carried out using ultrasonic welding equipment. The horn and anvil of the ultrasonic welding apparatus are specifically designed so that the ultrasonic stomping operation create a vertical hump on the zipper to stop the slider. Sufficient heat penetrates into the mass of the zipper profile in the end stop areas to fuse the zipper parts together.

The zipper in this example is an extruded plastic structure comprising mutually interlockable profiles. Zipper part 8 comprises a base 14 and two generally arrow-shaped rib-like male closure elements or members 20 and 28, while zipper part 6 comprises two pairs of hook-shaped gripper jaws 16, 18 and 22, 24 connected by a sealing bridge 12. Jaws 16 and 18 receive and interlock with the male element 20, while jaws 22 and 24 receive and interlock with the male element 28. Alternatively, one zipper part could have one male profile and one female profile, while the other zipper part has one female profile and one male profile, or the respective zipper parts could each have more than two male or female profiles.

The sealing bridge 12 and the base 14 are resiliently flexible self-supporting structures having a thickness greater than the thickness of the bag film. The male closure elements are integrally formed with the base 14, while the female closure elements are integrally formed with the sealing bridge 12. The upper margins of the walls 2*a* and 2*b* of the bag are joined to the backs of the sealing bridge 12 and the base 14 respectively, as seen in FIG. 2. In particular, it should be noted that there are no unattached tail portions at the film edges 70, 72 to interfere with slider insertion on or travel along the zipper.

The end face of the upper edge of the base 14, which carries the male closure elements 20 and 28, is inclined at about a 45° angle to facilitate loading of the slider onto the zipper from above without snagging on a corner of the upper edge. The top edge 70 of wall 2*b* is sealed against this inclined end face. The bottom edge 8 of the base 14 cooperates with a retaining ledge on the slider (to be described later) to increase the slider-pull-off resistance. For the same purpose, a rib 26 is formed on zipper part 6, the rib 26 cooperating with a retaining ledge on the other side of the slider.

In the slider-zipper assembly shown in FIG. 2, the slider 10 for opening or closing the reclosable zipper is generally shaped so that the slider straddles the zipper profiles. The upper margins of the bag walls 2*a* and 2*b*, which are joined to the backs of the zipper parts 6 and 8, are disposed between the respective zipper parts and the respective side walls of the slider.

Figure 3:
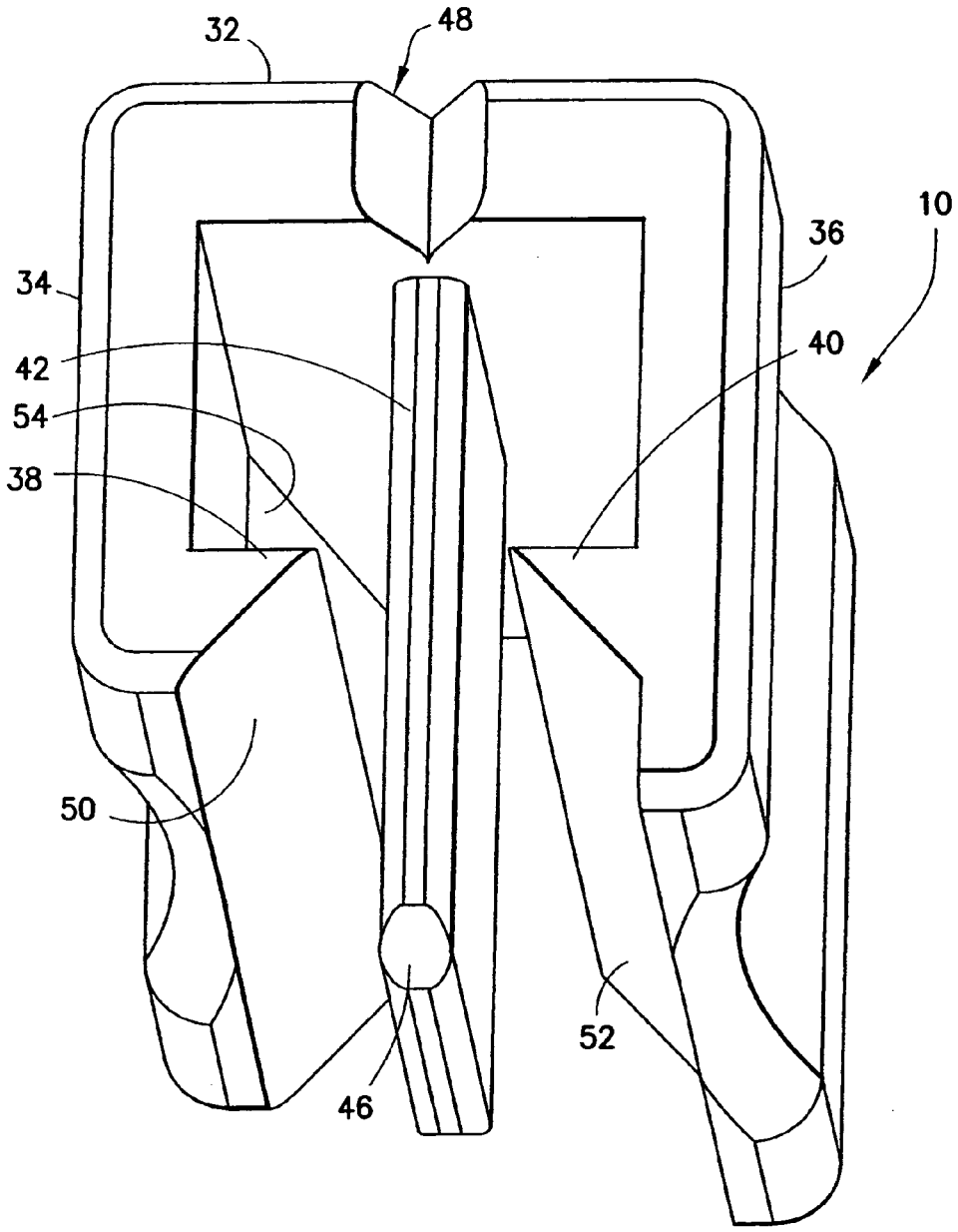
FIG. 3 is a drawing showing an isometric view of one type of slider that can be incorporated in the assembly depicted in FIG. 2.

FIG. 3 shows an isometric view of the slider 10 incorporated in the assembly depicted in FIG. 2. The slider 10 comprises a top wall 32, a pair of side walls 34 and 36 connected to opposing sides of the top wall 32, the top wall 32 and side walls 34, 36 forming a tunnel for passage of the string zipper therethrough. The ends of the slider are open to allow the zipper to pass through. The width of the tunnel is substantially constant along the section that is divided by the plow and then narrows from a point proximal to the end of the plow to the closing window at one end face of the slider. The narrowing section of the tunnel is formed by the substantially planar, inclined interior surfaces (only one of which, designated by numeral 54, is visible in FIG. 3), which converge toward the closing window of the slider. The inclined surfaces (e.g., 54) funnel or squeeze the zipper parts toward each other, causing the zipper profiles to interlock, as the slider is moved in the closing direction. The side walls 34 and 36 are formed with concave curved indentations where the user may place the tips of an index finger and a thumb for gripping the slider. Alternatively, convexities (e.g., ribs) could be formed on the sides of the slider to facilitate grasping.

The slider 10 also comprises a plow or divider 42 that depends downward from a central portion of the top wall 32 to an elevation below the lowermost portions of each side wall. The plow is disposed between opposing sections of the zipper parts that pass through the tunnel. The tip of the plow 42 is truncated and has rounded edges and flattened corners 46 at opposing ends for facilitating insertion of the plow between the zipper profiles without snagging during automated slider insertion. The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper parts 6 and 8 apart.

Although the slider in the disclosed embodiment has a plow, the string zipper, if suitably designed, could be actuated by a slider that has no plow or separating finger. The present invention is not limited in its application to string zipper bags having sliders with plows.

In the embodiment depicted in FIG. 3, the slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 have substantially coplanar, generally horizontal upper surfaces on which the bottom edges of the zipper profiles can sit, thereby effectively latching the slider under the bottom edges of the zipper parts to increase slider pull-off resistance. The ledges 38 and 40 further comprise respective inclined bottom surfaces that extend downward and outward from the respective inner edges of the generally horizontal surfaces. The inclined surfaces 50 and 52 are each substantially planar, with the respective planes of these inclined surfaces intersecting at a line inside the tunnel that is parallel to the longitudinal axis of the slider. The inclined surfaces 50 and 52 serve to guide the respective zipper parts 6 and 8 into the slider tunnel during insertion of the slider onto an open section of the zipper. Sliders with retaining ridges on the plow may also be used.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

Improved slider designs are disclosed in U.S. patent application Ser. No. 10/412,438, entitled "Molded Sliders for Actuating Zippers of Reclosable Packages". In one such design, the each retaining ledge on the interior surface of the slider side walls is replaced by a pair of retaining teeth spaced apart at opposite ends of the slider.

Figure 4:
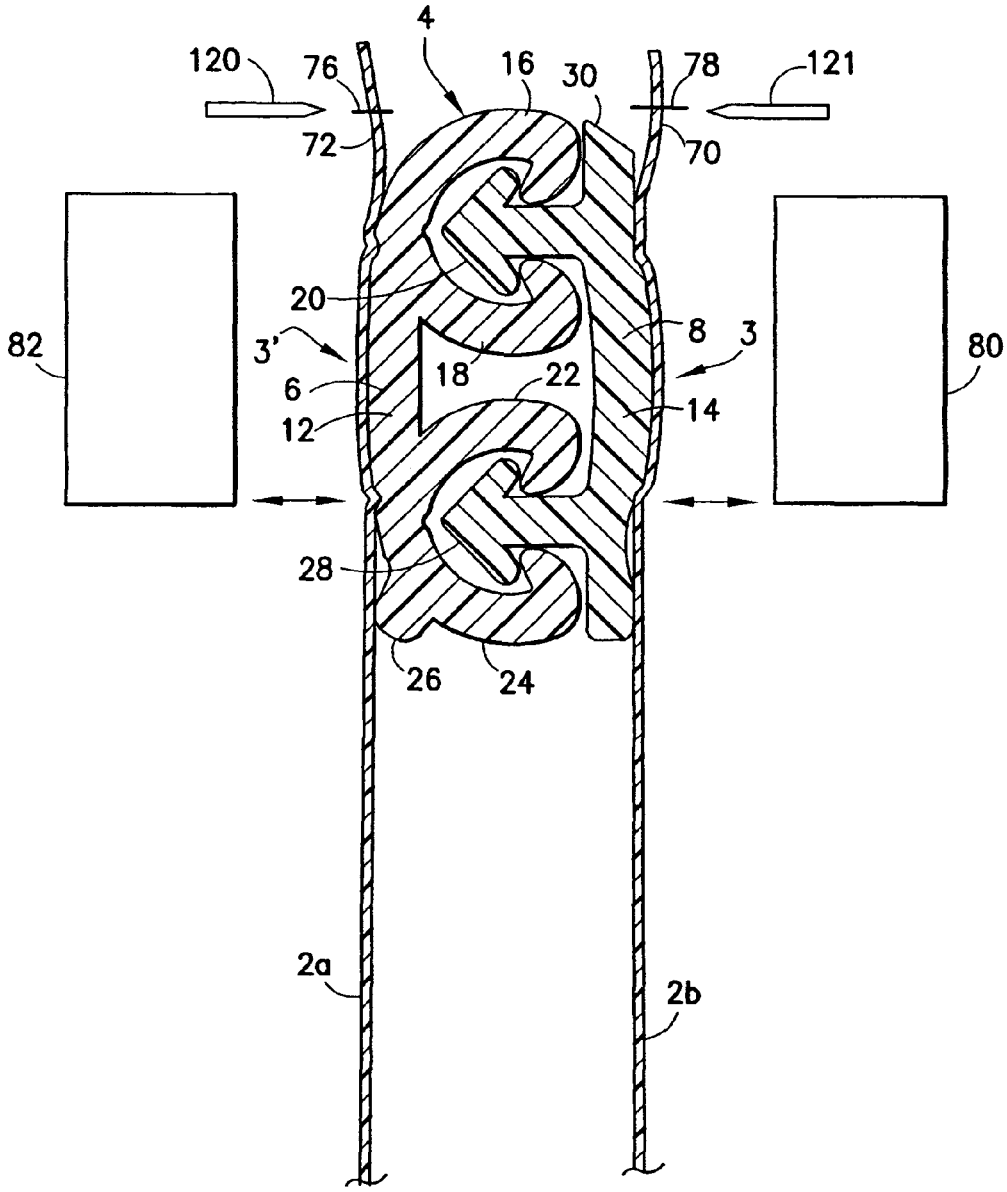
FIG. 4 is a drawing showing a fragmentary sectional view of a string zipper-film assembly during zipper sealing (and prior to trimming) in accordance with one method of manufacture.

FIG. 4 shows a stage in the manufacture wherein the zipper has been attached to the web, but the web has not yet been trimmed by cutting along lines 76 and 78. As seen in FIG. 4, the string zipper is placed between opposing portions of the web with marginal web portions extending beyond the zipper. The zipper is joined to the web of film by conventional conductive heat sealing using heated sealing bars 80 and 82 placed on opposing sides of the assembly. The sealing bars form band-shaped zones of joinder in central portions of the zipper strip backs. During this sealing operation, a portion of wall 2*a* is sealed to the back of the zipper strip 6, while a portion of wall 2*b* is sealed to the back of the zipper strip 8.

FIG. 4 depicts the case wherein an unsealed marginal portion of wall 2*a* extends beyond the zipper strip 6, while an unsealed marginal portion of wall 2*b* extends beyond the zipper strip 8. In the next stage of manufacture, portions of the unattached marginal portions are trimmed off by cutting knives 120, 121, which are in reality disposed downstream of the sealing bars 80 and 82, but are shown in FIG. 4 for the sake of economy. The unattached marginal portions of the web of film will be cut along lines 76 and 78, leaving tail portions 70 and 72 that are not attached to the zipper.

Figure 5:
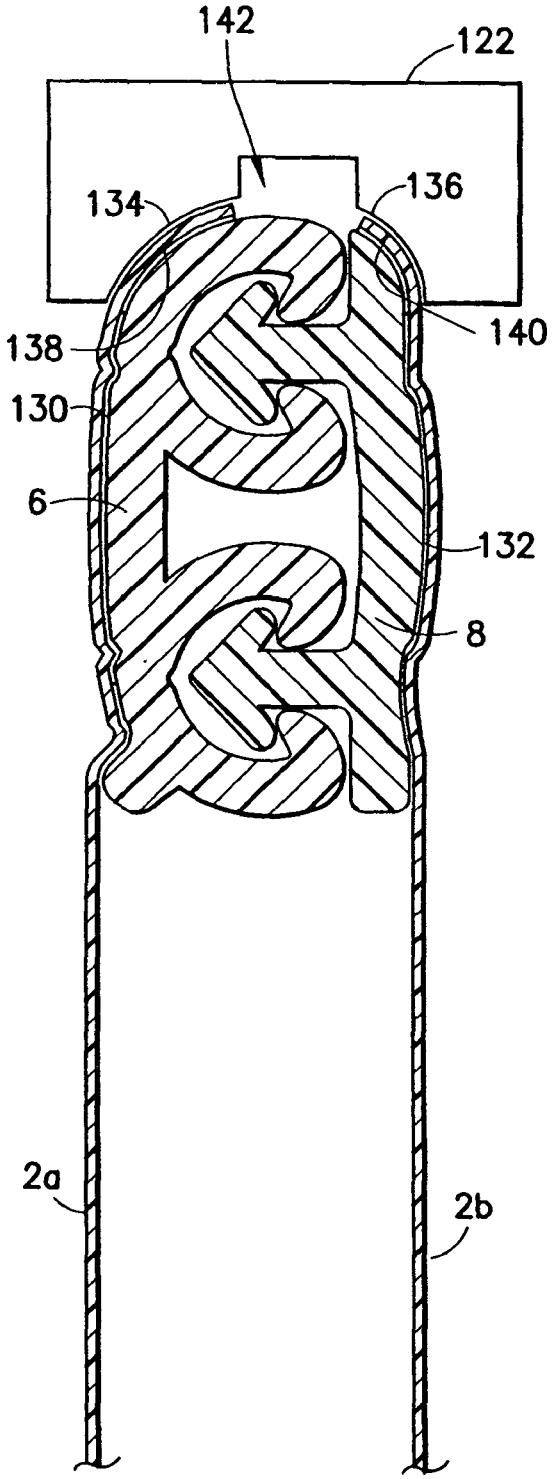
FIG. 5 is a drawing showing a fragmentary sectional view of a string zipper-film assembly during lip sealing in accordance with one embodiment of the present invention.

FIG. 5 shows the next stage of manufacture after trimming off of the marginal portions of the film on both sides of the zipper. A lip sealer 122 in the form of a heated sealing bar is used to seal the tail portions 70 and 72 to the zipper strips 8 and 6, respectively. As the zipper-film assembly advances continuously, the top of the zipper passes through a tunnel in the lip sealer 122. The tunnel has a substantially constant profile in the machine direction, which is directed into the page in FIG. 5. The tunnel profile is defined in part by a pair of surfaces 134 and 136 that are configured and positioned to heat seal the tails 70 and 72 (shown unattached in FIG. 4) to the zipper strips 8 and 6 respectively. The seals are symbolically indicated by the layers 138 and 140 in FIG. 5, although it should be understood that this representation is solely for the purpose of demonstrating the separate sealing zones. In fact, the film tail is directly fused to the corresponding zipper strip, so layers 138 and 140 merely represent fusion of the film tails to the zipper. Likewise layers 130 and 132 respectively represent fusion of the band-sealed portions of film walls 2*a* and 2*b* to the zipper strips 6 and 8.

In the embodiment shown in FIG. 5, the surfaces 134 and 136 are curved cylindrical sections. However, in cases where the zipper profile is closer to being rectangular or trapezoidal, the surfaces are preferably not curved and instead should be shaped to match the shape of the top corners of the respective zipper strips.

To avoid fusing the tops of the zipper strips together during lip sealing, the roof of the tunnel has a recess 142, thereby creating an open space that insulates the confronting portions of the zipper from the heat of the sealing bar 122. Also, the heat sealing of the film to the zipper is controlled to prevent seal-through of the zipper.

The operations depicted in FIGS. 4 and 5 are performed on a bag making machine. One embodiment of such a bag making machine 100 is partially depicted in FIG. 6. A web of bag making film is drawn from a supply reel 102, while a string zipper material comprising interlocked flangeless zipper strips is drawn from a supply reel 110. The drawn film passes around a guide roller 104 and over a folding board 106 that folds the web into a U or V shape. The folded web is pulled forward by a pair of pull rollers 108 (only one of which is visible in FIG. 6) and other drive roller downstream (not shown). The fold is designated by the numeral 64. The web of film 2 advances in the direction indicated by arrow A.

The drawn string zipper material is passed around guide rollers 112 and 114 and then through a zipper guide 116 that is situated between the opposing marginal portions of the film web. In its simplest form, the zipper guide may be a straight tube that maintains the zipper in the proper position and orientation relative to the opposing marginal portions of the film web, which in this case is parallel to the edges of the folded web. At a zipper sealing station, these marginal portions of the film are joined to the respective backs of the zipper strips by a pair of mutually opposing conventional heated sealing bars 80 and 82 (see FIG. 4). Only sealing bar 80 is visible in FIG. 6.

The zipper sealing station is conventional apparatus and is described hereinafter only briefly. As the folded web 2 with inserted string zipper 4 advances continuously between the opposing sets of sealing bars 80, 82, the respective zipper strips have their backs sealed to opposing marginal portions of the bag making film, thereby continuously attaching incoming sections of the moving string zipper to adjoining sections of the moving web. The sealing is accomplished by electrically heating the sealing bars, the heat being conducted through respective endless barrier strips (not shown) made of Teflon or similar material, which circulate on respective sets of rollers (not shown). Each Teflon barrier strips passes between a respective side of the folded web and a respective sealing bar in the gaps between the opposing sealing bars. The web and string zipper are sandwiched between and held together by the Teflon barrier strips, which move with the web and zipper and prevent the bag making film from sticking against the stationary heated sealing bars during conduction heat sealing. The Teflon barrier strips and intervening web and zipper pass through the nips of a series of guide rollers (not shown).

Downstream from the zipper sealing station, excess film that extends beyond the zipper is continuously trimmed by a pair of stationary knives 120 and 121 (see FIG. 4). Only knife 120 is visible in FIG. 6. Each knife trims a respective marginal portion of the film that extends beyond the tops of the zipper. The tips of the knife blades must be positioned so as to not cut the zipper, even during zipper wandering to and fro. The trimmed portion of the film is taken away by means not shown in FIG. 6. However, the aforementioned unattached tail portions 70 and 72 remain after cutting.

As previously stated, the presence of unattached film tails could interfere with slider insertion during manufacture as well as with slider operation during use of the reclosable package by a consumer. Therefore an additional step is performed of sealing the tails to the respective zipper strips. The tails are sealed by the lip sealer 122, which was previously described in detail with reference to FIG. 5.

The trimmed and lip-sealed zipper-film assembly then wends its way through a conventional dancer assembly (not shown), which converts the continuous advancement of the film into intermittent advancement of the film. In the intermittent advancement phase, the zipper-film assembly is moved one package increment and then stopped for a period of time, i.e., the dwell time. This cycle is repeated periodically.

In accordance with an alternative embodiment of the automated production line disclosed above, the web of film material and the string zippers could be moved intermittently through the zipper sealing and lip sealing stations. In this case respective lengths of the string zippers would be sealed to the film (e.g., by reciprocating sealing bars) during each dwell time, with the string zippers and film being advanced an equal length during each interval between successive dwell times. The trimming operation would be performed during advancement of the film.

Figure 6:
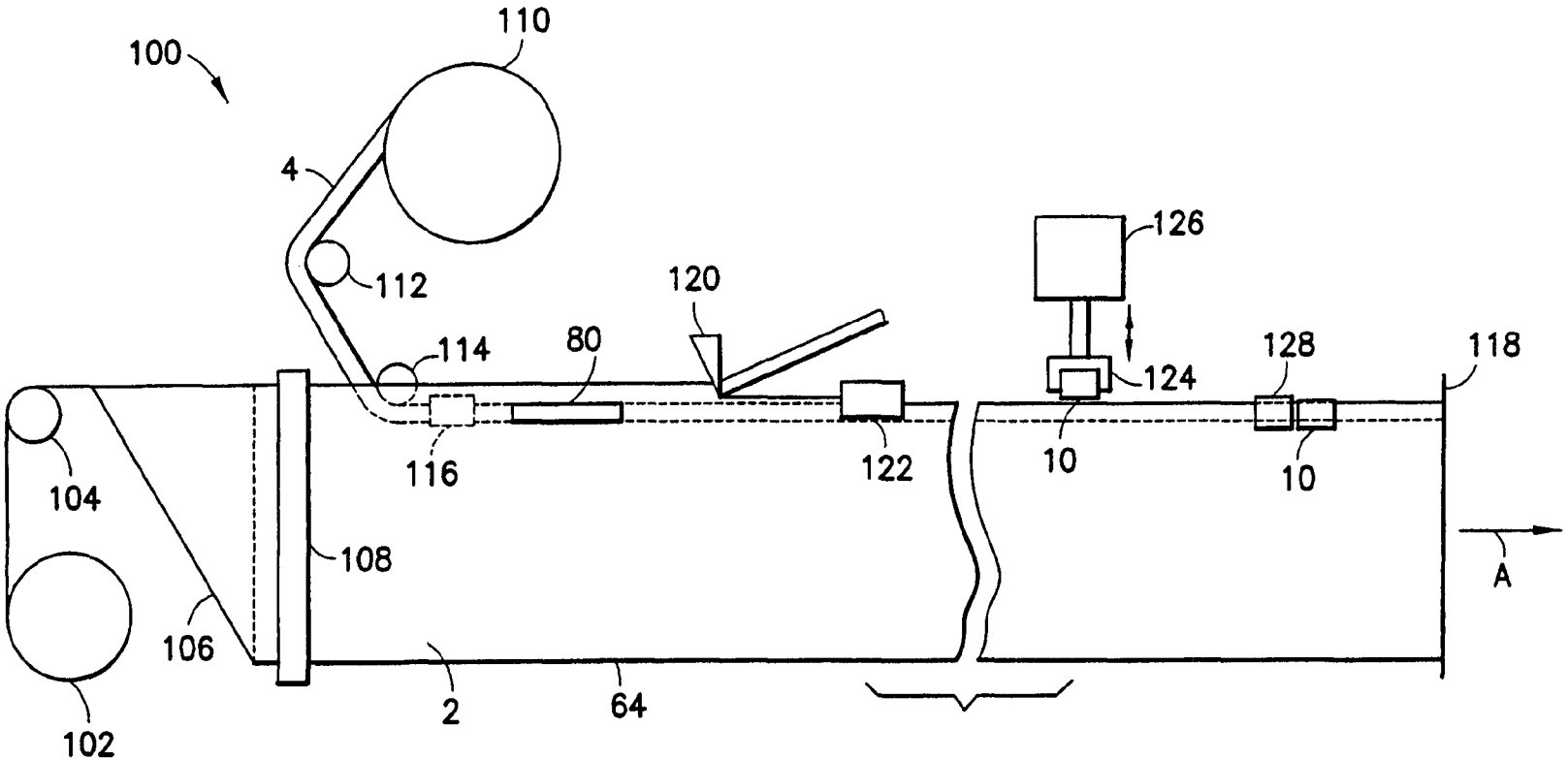
FIG. 6 is a drawing showing a side view of portions of an automated production line for manufacturing bags having slider-actuated string zippers, in accordance with one embodiment of the invention. The zipper-film assembly is advanced from left to right, as indicated by arrow A.

Still referring to FIG. 6, at the first station after the dancer assembly, a respective slider (e.g., slider 10 shown in FIG. 3) is inserted onto the zipper-film assembly after each advancement of the film. The slider insertion device comprises a pusher 124 that pushes a slider 10 onto an open section of the zipper in a slider insertion zone. The pusher displacement is driven by an air cylinder 126. The pusher is fixed to a distal end of a rod of a piston slidable inside the cylinder 126. The pusher 124 is alternately extended and retracted by actuation of the air cylinder 126, which has two separate ports (not shown) for intake of compressed air from separately controlled air lines. A succession of sliders 10' are fed periodically along a track (not shown) by a conventional pneumatic slider feeding system (not shown). When the pusher 124 is retracted, the next slider must be automatically fed to a pre-insertion position directly in front of the pusher.

During the same dwell time that a slider is being inserted, a slider end stop structure is being formed on the zipper at an ultrasonic stomping station downstream from the slider insertion zone. The stomping station comprises a horn 128 and an anvil (not shown). This slider end stop structure will be bisected later when the film and zipper are cut in the cross direction using a hot knife 118 that both severs and seals the film.

Figure 7:
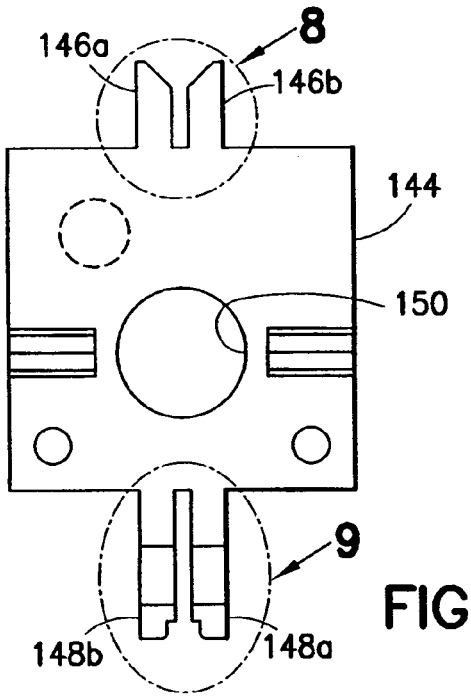
FIG. 7 is a drawing showing an end view of a lip or edge sealer heater block in accordance with another embodiment of the invention.
Figure 8:
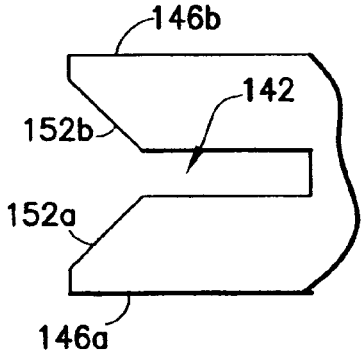
FIG. 8 is a drawing showing the portion inside circle 8 in FIG. 7 on a larger scale.
Figure 9:
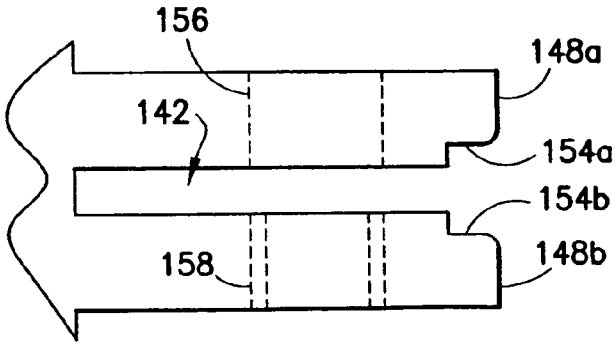
FIG. 9 is a drawing showing the portion inside circle 9 in FIG. 7 on a larger scale.

FIGS. 7–9 show a lip sealer heater block 144 that can be used in place of the lip sealer 122 of FIG. 5. This heater block has two different sets of contact fingers 146*a*, 146*b* and 148*a*, 148*b* projecting from opposite sides of the sealer block. The sealer block 144 can be installed in a holder (not shown) in either of two positions, namely, with the contact fingers 146*a*, 146*b* projecting toward the zipper to be sealed, or with contact fingers 148*a*, 148*b* projecting toward the zipper. In other words, the installed position of the lip sealer heater block is reversible. The holder is mounted to the end of a rod, which is in turn connected to a piston inside an air cylinder (not shown), which is controlled in conventional manner by a programmed logic controller (not shown) for selectively extending and retracting the lip sealer heater block. The heater block is extended for sealing during machine operation and film movement and retracted as the film comes to rest in order to avoid overheating the film and zipper. An electrical heating element (not shown) resides inside the circular bore 150, seen in FIG. 7.

The respective sets of contact fingers have respective geometries that facilitate machining. {The curved contact surfaces shown in FIG. 5 are difficult to machine.] As seen in FIG. 8, the contact fingers 146*a*, 146*b* have respective contact surfaces 152*a*, 152*b* that are generally planar and inclined at acute angles to form a V shape. As seen in FIG. 9, the contact fingers 148*a*, 148*b* have respective contact surfaces 154*a*, 154*b* that are generally rectilinear and form a U shape. In addition, the relative positions of the contact surfaces 154*a*, 154*b* are adjustable using an adjusting screw that is passed through an unthreaded bore 156 in contact finger 148*a* and threads into a threaded bore 158 in contact finger 148*b*. The contact surfaces 154*a* and 154*b* can be moved toward and away from each other by turning the screw in opposite directions. Thus the lip sealer is adjustable for use with zippers of different width.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc.

What is claimed is:

1. A method of manufacture comprising the following steps:

(a) joining a first portion of a length of film material to a back of a length of a first flangeless zipper strip having a first closure profile on its front;

(b) joining a second portion of said length of film material to a back of a length of a second flangeless zipper strip having a second closure profile on its front, said first and second closure profiles of said respective lengths of said first and second zipper strips being interlockable to form a length of string zipper assembly;

(c) after steps (a) and (b), removing a first unattached marginal portion of said length of film material that extends beyond said joined first portion of said length of film material, leaving a first tail portion of said length of film material unattached to said first flangeless zipper strip; and (d) after step (c), joining said first tail portion of said length of film material to said first flangeless zipper strip.

2. The method of manufacture as recited in claim 1, further comprising the following steps:

(e) after steps (a) and (b), removing a second unattached marginal portion of said length of film material that extends beyond said joined second portion of said length of film material, leaving a second tail portion of said length of film material unattached to said second flangeless zipper strip; and (f) after step (e), joining said second tail portion of said length of film material to said second flangeless zipper strip.

3. The method of manufacture as recited in claim 2, further comprising the step of loading a slider onto said string zipper.

4. The method as recited in claim 2, wherein said length of film material is advancing continuously during said joining and removing steps and is not advancing during said slider loading step.

5. The method as recited in claim 1, further comprising the step of folding said length of film material along a line that places said first and second portions of said length of film material in mutually confronting positions.

6. The method as recited in claim 1, wherein said film material is made of thermoplastic material, and each of said joining steps comprises the step of conductive heat sealing thermoplastic material to said zipper strips.

7. The method as recited in claim 3, further comprising the following steps:

folding said length of film material along a line that places said first and second portions of said length of film material in mutually confronting positions;

fusing said first and second flangeless zipper strips together in first and second zones of fusion having respective centerlines separated by a distance equal to one package length;

sealing opposing portions of said folded length of film material together along first and second zones of cross sealing having respective centerlines separated by a distance equal to one package length, the centerline of said first zone of cross sealing being generally collinear with the centerline of said first zone of fusion, and the centerline of said second zone of cross sealing being generally collinear with the centerline of said second zone of fusion; and cutting said string zipper and said film material generally along said centerlines.

8. A machine comprising:

first joining means for joining a first portion of a length of film material to a back of a length of a first flangeless zipper strip;

second joining means for joining a second portion of said length of film material to a back of a length of a second flangeless zipper strip;

first trimming means for removing a first unattached marginal portion of said length of film material that extends beyond said joined first portion of said length of film material, leaving a first tail portion of said length of film material unattached to said first flangeless zipper strip; and third joining means for joining said first tail portion of said length of film material to said first flangeless zipper strip, wherein said first trimming means is disposed between said first and third joining means.

9. The machine as recited in claim 8, wherein said third joining means comprise a heated contact surface of a member made of heat-conductive material.

10. The machine as recited in claim 9, wherein said contact surface has a generally constant concave profile along its length.

11. The machine as recited in claim 8, further comprising:

second trimming means for removing a second unattached marginal portion of said length of film material that extends beyond said joined second portion of said length of film material, leaving a second tail portion of said length of film material unattached to said second flangeless zipper strip; and fourth joining means for joining said second tail portion of said length of film material to said second flangeless zipper strip, wherein said second trimming means is disposed between said second and fourth joining means.

12. The machine as recited in claim 8, wherein said third and fourth joining means comprise first and second contact surfaces of respective first and second contact fingers.

13. The machine as recited in claim 12, further comprising a heater block made of heat conductive material, said first and second contact fingers projecting from one side of said heater block, and third and fourth contact fingers projecting from another side of said heater block and comprising third and fourth contact surfaces respectively, wherein said first and second contact surfaces have a profile different than a profile of said third and fourth contact surfaces.

14. The machine as recited in claim 12, wherein said first and second contact surfaces each have a profile that is concave curved, approximately rectilinear or planar.

15. The machine as recited in claim 8, wherein said first trimming means comprise a knife.

16. The machine as recited in claim 8, further comprising a slider insertion device for loading sliders onto said string zipper, said slider insertion device being located downstream of said third joining means.

17. A method of manufacture comprising the following steps:

(a) interlocking a first closure profile of a first flangeless zipper strip with a second closure profile of a second flangeless zipper strip;

(b) joining a first band-shaped portion of an elongated film structure to a back of said first flangeless zipper strip;

(c) joining a second band-shaped portion of said elongated film structure to a back of said second flangeless zipper strip;

(d) removing a first unattached marginal portion of said elongated film structure that extends beyond said joined first band-shaped portion of said elongated film structure, leaving a first tail portion of said elongated film structure unattached to said first flangeless zipper strip;

(e) joining said first tail portion of said elongated film structure to said first flangeless zipper strip; and (f) inserting a slider on said interlocked first and second zipper strips some time after completion of steps (a) through (e).

18. The method as recited in claim 17, further comprising the following steps, performed prior to step (f):

removing a second unattached marginal portion of said elongated film structure that extends beyond said joined second band-shaped portion of said elongated film structure, leaving a second tail portion of said elongated film structure unattached to said second flangeless zipper strip; and joining said second tail portion of said elongated film structure to said second flangeless zipper strip.

19. The method as recited in claim 18, wherein said elongated film structure is formed by folding a web of film, said first and second unattached marginal portions being adjacent opposing edges of said folded web.

20. The method as recited in claim 18, wherein said elongated film structure is formed by sealing a pair of webs along a band-shaped zone proximal to first opposing edges of said webs, said first and second unattached marginal portions being adjacent to second opposing edges of said webs.

21. The method as recited in claim 17, wherein step (a) is performed before steps (b) and (c).

22. The method as recited in claim 17, wherein steps (b) and (c) are performed before step (a).

23. The method as recited in claim 17, wherein said elongated film structure is advancing continuously during said joining and removing steps and is not advancing during said slider loading step.

24. The method as recited in claim 17, wherein said elongated film structure is made of thermoplastic material, and each of said joining steps comprises the step of conductive heat sealing said first and second band-shaped of said elongated film structure to said zipper strips.

25. The method as recited in claim 17, further comprising the following steps:

fusing said first and second flangeless zipper strips together in first and second zones of fusion having respective centerlines separated by a distance equal to one package length;

sealing opposing portions of said elongated film structure together along first and second zones of cross sealing having respective centerlines separated by a distance equal to one package length, the centerline of said first zone of cross sealing being generally collinear with the centerline of said first zone of fusion, and the centerline of said second zone of cross sealing being generally collinear with the centerline of said second zone of fusion; and cutting said string zipper and said elongated film structure generally along said centerlines.

* * * * *